United States Patent [19]

Haines, Jr. et al.

[11] 4,261,153

[45] Apr. 14, 1981

[54] ACCESSIBLE-DEMOUNTABLE SUPPORT SYSTEM FOR WALL PANELING AND REVERSIBLE CLIP MEANS USED THEREIN

[75] Inventors: Charles Haines, Jr., Lancaster; Henry F. Murr, Mountville, both of Pa.

[73] Assignee: Armstrong Cork Company, Lancaster, Pa.

[21] Appl. No.: 25,468

[22] Filed: Mar. 30, 1979

[51] Int. Cl.[3] ..... F04B 5/52

[52] U.S. Cl. ..... 52/489; 52/712

[58] Field of Search ..... 52/509, 506, 489, 712, 52/355, 665, 281

[56] References Cited

U.S. PATENT DOCUMENTS

| | | | |
|---|---|---|---|
| 2,499,278 | 2/1950 | Olsen | 52/489 X |
| 3,319,983 | 5/1967 | Zibell | 52/489 X |
| 3,412,515 | 11/1968 | Finon | 52/489 X |
| 4,041,668 | 8/1977 | Jahn et al. | 52/489 |
| 4,157,000 | 6/1979 | Sutter | 52/489 |

*Primary Examiner*—Price C. Faw, Jr.

*Assistant Examiner*—Carl D. Friedman

[57] ABSTRACT

An accessible-demountable support system for kerfed-edge wall paneling and reversible clip means used therein. The system includes vertical splines or runners each having a central web portion with pairs of front and rear flanges extending outwardly in opposite directions at right angles to the web. The front pair of flanges is adapted to be engaged in kerfs in opposing edges of wall panels. One of the rear flanges is adapted to be demountably secured to wall-mounted horizontal support members by reversible resilient clip means. The configuration of the clips is such that when one portion thereof is removably but rigidly affixed to the rear flange of a vertical spline, another portion may be hooked over an upstanding flange on a horizontal support member. This enables the simultaneous movement of the spline and clips thereon to dismount the clips from the horizontal support members, or mount and adjust the clips and spline thereon, thus providing an easily accessible-demountable support system for kerfed-edge wall construction units.

7 Claims, 4 Drawing Figures

ACCESSIBLE-DEMOUNTABLE SUPPORT SYSTEM FOR WALL PANELING AND REVERSIBLE CLIP MEANS USED THEREIN

BACKGROUND OF THE INVENTION

1. Field of the Invention

The present invention relates to an accessible-demountable support system for mounting wall panels in spaced relation to an existing wall or supporting surface. More particularly, the invention relates to such a system wherein flanges vertical splines or runners are coupled to vertically spaced flanged horizontal support members by clip means installed at locations where the vertical and horizontal elements cross. The clip means employed is of a design which enables them to be retained in position on the vertical splines when they are moved. This enables all of the clips to be dismounted from/or mounted on the horizontal support members simultaneously with ease during removal or installation of wall panels.

2. Description of the Prior Art

The invention herein is an improvement over conventional wall paneling systems. Such systems are basically composed of vertically spaced elongated horizontal primary elements mounted on a support surface, and vertical panel-supporting splines secured to the primary elements at their points of overlap. In some prior systems, the means for attaching the vertical splines to the horizontal support members included wire-tying, welding, rivets, and screws. It is also known to secure the vertical spline members to the horizontal support members by means of clips installed at the points of overlap of the horizontal and vertical support members. It is further known to employ vertical panel-support members for use with prefabricated panels having kerfed edge portions wherein the vertical members include means for engaging kerfs of a pair of abutting panel edges.

As shown by U.S. Pat. No. 1,836,828, it is known to provide vertical panel-support members permanently mounted on a wall and to use metallic clips provided with raised portions adapted to be placed and held on a flange of the vertical support members by spring-like action. The clips are shaped to fit snugly over an edge portion of a panel member and are provided with oppositely extending tongue portions which extend along the flat surface of abutting panels in installed positions.

U.S. Pat. No. 3,412,515 discloses an assembly for installing kerfed-edge wall panels, including flanged wall-mounted horizontal members, flanged vertical spline members, and coupling means in the form of clips for slidably and detachably connecting the horizontal and vertical members at their points of overlap. The clip means is held on the horizontal member by spring lug portions of the clip. A raised lug is provided in the central portion of the clip to slide over a rear flange of a vertical member. The cooperation of the specially designed flanged vertical member and the clip which is movably mounted on the horizontal member permits variation of dimensions of the panels due, for example, to climatic conditions which would normally cause buckling thereof.

U.S. Pat. No. 2,481,794 relates to a ceiling construction comprising panels provided with a kerf in the edges thereof. In contrast to permanently installed ceilings of this type, this patent discloses an arrangement whereby the panel ceiling and its supports are so arranged that a panel or panels may be quickly and easily removed without destroying or damaging any thereof. This is made possibly by the use of splines having an inverted T-shaped cross section, the stem of the T including a groove longitudinally of the spline and the two halves of the head of the T being adapted to engage adjoining kerfs of a pair of abutting panels. Adapted to cooperate with the spline by sliding thereon is a hanger member or clip having a vertically disposed web, the bottom of which is formed to provide a pair of opposed flanges extending laterally from both sides of the web to provide a slot which may engage one laterally extending flange of the spline. The web of the clip is provided with a notch adapted to be engaged over a runner part of the supporting structure. An inwardly extending projection is provided near the outer open end of the notch to prevent dislodgment of the clip from the runner. To remove a ceiling panel, a knife blade is inserted between a pair of abutting panels and within the groove, and backward pressure is applied to the clip to dislodge it from the runner. Other clips associated with the spline are similarly acted upon, thus freeing the panels to be removed.

U.S. Pat. No. 3,732,660 relates to a wall construction system for supporting rigid wall boards on a support structure by using interlocking clips. One of the clips used to secure the wall board to supporting studs includes a U-shaped channel portion adapted to be mounted over the edge of a wall board. A tab portion extending perpendicularly from the side of the U-shaped portion of the clip is provided with notched and flared surfaces, which are disposed to slide over and interlock by spring action with the support structure.

Although it has long been desired to have a means for coupling the kerfed-engaging spline members of a wall paneling support system to the wall-mounted support elements in a manner which would render the spline and the coupling means readily accessible for simplified installation and removal of panels, the prior art has not satisfactorily solved the problem.

SUMMARY OF THE INVENTION

According to the present invention, there is provided an accessible and demountable support assembly for mounting kerfed wall construction units on a support surface. The assembly includes vertical, horizontally spaced flanged spline members, coupled to elongated vertically spaced flanged horizontal, wall-mounted support members by clips which are removably but tightly secured on a spline flange and slidingly spring-held on the horizontal support member. The splines each have a central longitudinal web portion with a first pair of flanges extending in opposite directions on one side of the web and adapted to be coupled to a flange of a horizontal support member by clip means and a second pair of flanges extending in opposite directions on the other side of the web adapted to be engaged in the kerfs of abutting opposed edges of a pair of wall panels. Preferably, one of the first pair of flanges extends out beyond the corresponding flange of the second pair of flanges and has a longitudinal groove spaced inwardly from the outer edge thereof. The clip means is substantially J-shaped in central longitudinal cross section and has a short and a long body portion extending substantially parallel and in spaced relation to each other. The short body portion is substantially flat and has inwardly depressed end portions at the sides thereof which are adapted to snap into the groove in the extended one of the first pair of flanges of a vertical spline and be held thereon with sufficient force to assure retention of the clip in position when the spline is moved. The long body portion of the clip is also substantially flat and rectangular and has integral cut and raised portions on each side of the end thereof bent to form spring tabs which are adapted to slidably engage a flange of a horizontal primary support element when the clip is positioned on a flange of a vertical spline member. The vertical spline members and the clip means mounted thereon are thus movable together to engage or disengage the clip means from the horizontal primary elements. Wall construction units having kerfs in their vertical edges are removably mounted between the vertical spline members with the second pair of flanges of each engaged in the kerfed edge portions on the opposing edges of the units.

DESCRIPTION OF THE PREFERRED EMBODIMENT

Figures 1, 2, 3, 4:
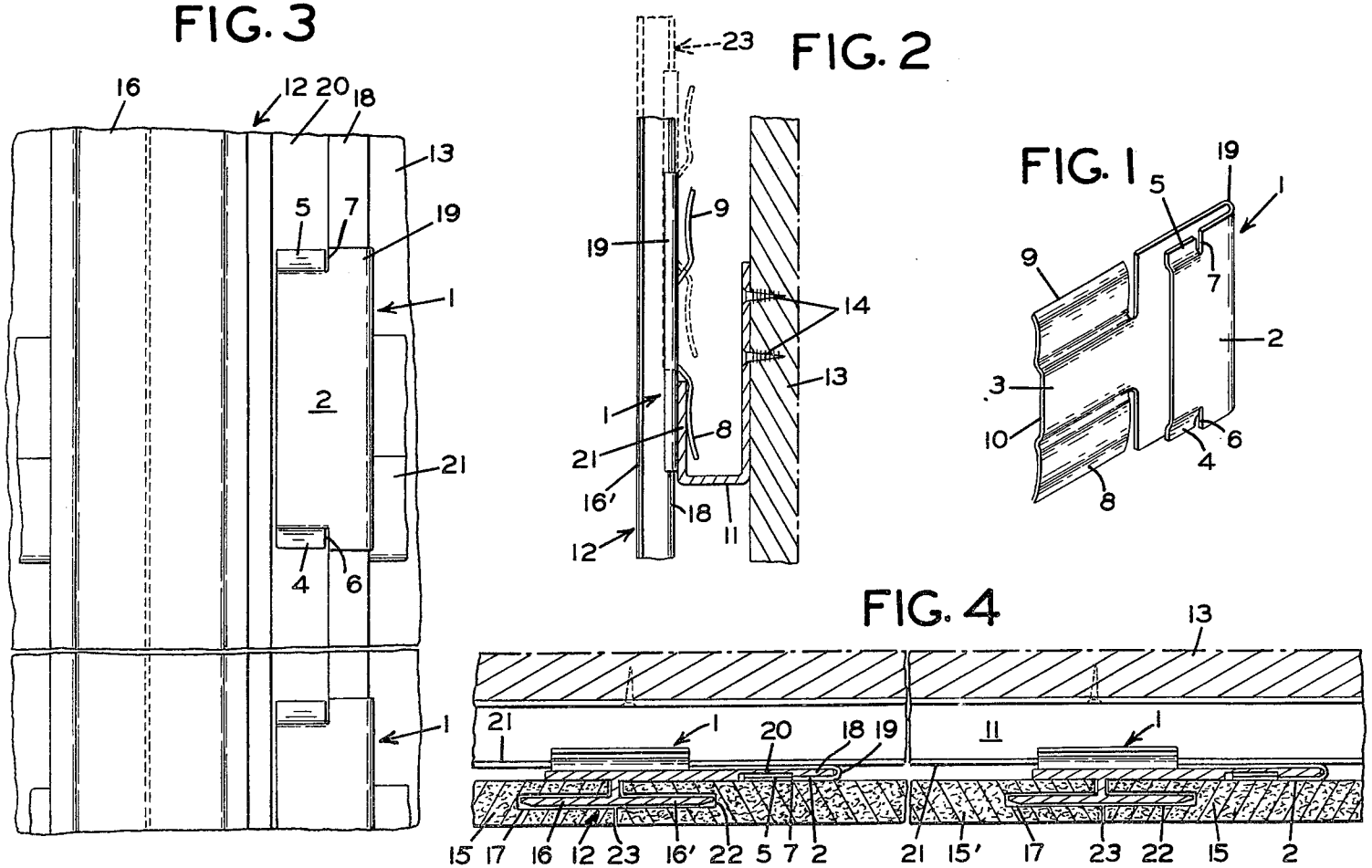
FIG. 1 is an isometric view of the clip of this invention.
FIG. 2 is a side elevational view, partially in section, showing a horizontal primary support member mounted on a support surface and a vertical spline coupled to the primary support member by the clip of FIG. 1.
FIG. 3 is a front elevational view partially broken away and showing an assembly of a vertical spline mounted on vertically spaced horizontal support members by the clip means of this invention.
FIG. 4 is a top view, partially broken away and in section, showing kerfed-edge wall panels mounted in spaced relation to a support surface by means of horizontally spaced vertical spline members coupled to the horizontal primary support-surface-mounted member by the clip means of this invention.

The accessible-demountable support system for wall paneling and the reversible clip means used therein of this invention can be used to install wall paneling on any support surface such as a wall itself, or on metal studs attached to the wall, or it can be used to install the paneling over openings in building walls which contain windows; for example, such as those used in factories and institutions or the like where it is desired to provide an insulating system therefor.

Referring to the drawings, there is shown in FIG. 1 the clip 1 of this invention. As shown, the clip is substantially J-shaped in longitudinal cross-section; and it comprises an integral structure formed from a single, normally flat, rectangular blank of sheet material shaped and folded as indicated in FIG. 1. As shown, the clip has a short body portion 2, and a long body portion, 3, which extend substantially parallel and in spaced relation to each other. The short body portion 2, is substantially flat and has inwardly depressed end portions 4 and 5 on the sides thereof. As shown, the depressed end portions, 4 and 5, may be formed by first forming cuts 6 and 7 prior to depressing the portions 4 and 5. Obviously, the depressed portions 4 and 5 could be formed without first forming the cuts 6 and 7, since it is only required that the depressed portions be formed in some manner to provide an inwardly offset portion of the clip at these points to ensure that, as further elaborated on later herein, will engage a flange of a vertical spline, when placed thereon, with sufficient force to tightly hold it on the flange so that it will not move out of position when the vertical spline and clips thereon are removed from the horizontal support members or are installed thereon.

As further shown in FIG. 1, the longer portion body portion 3 of the clip 1 is provided with integral cut and raised portions 8 and 9 on each side of the end 10 thereof.

Portions 8 and 9, as shown, are bent to form spring tabs which are adapted to slidably engage a flange 21 (see FIG. 2) of a horizontal panel support member 11 when clip 1 is positioned on the vertical spline 12.

As shown in the drawings, the clip and support system of this invention is particularly adapted to mount kerf-edged wall panels on a support surface in spaced relation thereto. As indicated earlier herein, the horizontal support members 11 may be mounted directly on an existing wall or may be mounted on studs attached to the wall, or over an opening in a wall which contains a window.

As shown in FIG. 2 of the drawings, the horizontal support member 11 which in this case has the transverse cross-sectional shape of a J, is mounted on a support surface 13 by fastening means such as indicated at 14.

In assembling the wall panel support system of this invention, horizontal support members 11 are normally mounted on the support surface 13 in locations about one foot below and one foot above the predetermined location of the top and bottom edges of a panel to be installed thereon. Intermediate horizontal support members 11 are then approximately equally spaced therebetween at distances of about 12 inches from the bottom support member 11 to approximately a height of 5 feet. Then, normally, one of the support members 11 is installed between the one at the 5-foot height and the top one.

Kerfed-edge wall panels 15 and 15', such as shown in FIG. 4, are installed on the support system of this invention by placing one of the panels 15 in an upright position against the horizontal support members 11. A flange 16 of the vertical spline member 12 is then inserted into the kerf 17 of one of the panels 15. As shown in FIGS. 2 and 3, clips 1, as required, are then installed at locations on the flange 18 of spline 12, at the point of overlap of the vertical splines and the horizontal support members by first hooking the portion 8 of the clip 1 onto the upstanding flange 21 of horizontal support member 11 and then sliding the U-shaped portion 19 of the clip 1 over the flange 18 of the spline 12 until the depressed portions 4 and 5 of the short body portion 2 of the clip 1 snaps into the groove 20 of the flange 18. The spring action of the depressed portions 4 and 5 of the clip 1 holds the clips firmly but movably in position on the vertical spline 12. The clips 1 are then in the position most clearly shown in FIG. 2 wherein the cut and raised portion 8 of the side of the long body portion 3 of the clip 1 is hooked over the upstanding flange portion 21 of the horizontal support member 11. One or more of the clips 1 may be used as required at the points of overlap of the vertical spline members 12 and the horizontal support members 11. Any horizontal support members 11, not attached to spline members 12 still function to provide horizontal support for wall panels 15 and 15'. Another panel 15' (FIG. 4) is then placed against the horizontal support members 11 and slid into place with the flange 16' of vertical spline 12 being installed in the kerf 22 of the panel 15'. The procedure is continued for the installation of panels subsequently mounted on the support structure. The cut and raised portion 9 of the long body portion 3 of the clip 1 is provided to permit use of the use of the clip on the upstanding flange 21 of the horizontal support member 11 in a reversed position where this would be required, for example, at the corner of a room. When the cut and raised portion 9 of the clip is mounted on the flange 12 of the horizontal support member 11, the flange 18, of course, would then extend in the opposite direction from that shown in FIG. 4.

One of the main features of this invention is the accessibility and demountability of the vertical spline members and clips, and the panels mounted thereon, and the ease with which new panels or replacement panels may be mounted on the support structure. If it is desired to remove panels from the system, it is merely required that an appropriate tool, for example, such as a putty knife modified to provide a hook at the end thereof, be inserted in one of the joints 23 (FIG. 4) between panels 15 and 15' at the bottom of the spline 12, hooking the tool onto the bottom of spline 12 and lifting up thereon. This disengages all of the clips 1 from the flanges 21 of the horizontal support members 11. This step is repeated on the other side of the panel to be removed. The clips 1 remain in place on the flange 18 of the spline members 12 as the spline is moved upwardly, and since, for example, as shown in FIG. 2 in dotted lines at 23 which indicates the raised position of the vertical spline 12 with the clips 1 thereon, the raised portion 8 of the clip 1 would be above flange 21 of the horizontal support member 11. The bottom of the loose vertical splines may then be pulled outwardly and the panel removed.

Replacement of paneling utilizing the support system of this invention is a simple and easy procedure. With the vertical spline members and clips thereon in the position indicated at 23 in FIG. 2, the splines 12 and clips 1 may be moved outwardly and a kerfed-edge replacement panel may be mounted on the spline members, making sure portion 8 of the clip 1 is slightly above the upstanding flange 21 of the horizontal support member 11, by insertion of the flanges 16 and 16' in the kerfs 17 and 22 thereof respectively, after which the bridged panels are pushed against the horizontal support members. While holding the panels tight against the horizontal support members, the hooked tool is then inserted between the panels into contact with the top of the vertical spline member, and by exerting a downward pull thereon, the raised portions 8 of all of the clips 1 mounted on the spline 12 are slid over the flange 21 of the horizontal support member 11, thus securing the vertical spline and the panels thereon. Such a wall panel assembly can be completed by edge moldings, skirting boards, angle moldings, etc., in a known manner.

What is claimed is:

1. A clip for removably coupling vertical and horizontal flanged wall panel support members together at substantially right angles to each other, said clip comprising an integral structure formed from a single, normally flat, rectangular blank of sheet metal, shaped and folded to provide a structure which is substantially J-shaped in central longitudinal cross-section and having short and long body portions extending substantially parallel and in spaced relation to each other, said short body portion being substantially flat and having inwardly offset portions on the sides of the end thereof adapted to so engage a flange of a vertical panel support member inserted between the two body portions that the flange is gripped between them with sufficient force to assure retention of said clip in position thereon upon movement thereof, said long body portion of said clip being substantially flat and rectangular with at least one integral cut and raised portion on at least one side of the end thereof, adapted to slidably engage a flange of a horizontal panel support member when said clip is positioned on said vertical panel support member.

2. A clip according to claim 1 wherein the inwardly offset portions on the sides of the ends of the short body portion comprise notched and inwardly flared tabs.

3. A clip according to claim 1 wherein the integral cut and raised portion of the end of the long body portion comprises an integral cut and raised portion on each side of the end thereof, at least one of which is adapted to slidably engage a flange of a horizontal support member when the clip is positioned on said vertical panel support member.

4. An accessible and demountable support assembly for mounting kerfed wall construction units on a support surface comprising in combination:

(a) a support surface;

(b) elongated, horizontally positioned primary elements mounted in vertically spaced locations on said support surface, each of said primary elements including, when in installed position, integral means thereon spaced outwardly from said support surface and adapted to receive clip means for coupling subsequently applied vertical spline members to the horizontal primary elements;

(c) elongated spline members vertically positioned in overlapping relationship with said horizontal primary elements, said spline elements each having a central web portion extending substantially the entire length thereof, a first pair of flanges extending in opposite directions on one side of the web portion and adapted to be coupled to one of said primary elements by clip means, a second pair of flanges extending in opposite directions on the other side of the web and adapted to engage the kerfs in the longitudinal edges of wall construction units;

(d) clip means mounted on one flange of said first pair of flanges of each of said spline members at at least one of the places where they overlap said primary horizontal elements, each of said clip means comprising an integral structure formed from a single, normally flat, rectangular blank of sheet metal, shaped and folded to provide a structure which is substantially J-shaped in central longitudinal cross-section and having short and long body portions extending substantially parallel and in spaced relation to each other, said short body portion being substantially flat and having inwardly offset portions on the sides of the end thereof adapted to so engage a flange of a vertical panel support member inserted between the two body portions that the flange is gripped between them with sufficient force to assure retention of said clip in position thereon upon movement thereof, said long body portion of said clip being substantially flat and rectangular with at least one integral cut and raised portion on at least one side of the end thereof adapted to slidably engage a flange of a horizontal panel support member when said clip is positioned on said vertical spline member, said vertical spline member and the clip means thereon thus being movable together to engage or disengage said clip means from said horizontal primary elements; and (e) wall construction units having kerfs in at least two opposed edges, said wall construction units being removably mounted on said vertical spline members with a flange of each of said second pair of flanges thereof engaged in the kerfs of opposed edges of said wall construction units.

5. An accessible and demountable support assembly for mounting kerfed wall construction units on a support surface according to claim 4 wherein the elongated horizontally positioned primary elements mounted at vertically spaced locations on said support surface, each include, when in installed position, a first upstanding flange secured to said support surface, an integral web portion extending outwardly from the bottom of said first flange and perpendicular thereto and, a second shorter flange spaced outwardly from said first flange by said web portion and extending upwardly therefrom.

6. An accessible and demountable support assembly for mounting kerfed wall construction units on a support surface according to claim 4 wherein the inwardly offset portions on the sides of the end of the short body portion of the clip which is adapted to so engage a flange of a vertical panel support member inserted between the two body portions that the flange is gripped between them with sufficient force to assure retention of said clip in position thereon upon movement thereof, comprises notched and inwardly flared tabs on the sides of the end thereof.

7. An accessible and demountable support assembly for mounting kerfed wall construction units on a support surface according to claim 4 wherein the integral cut and raised portion on the end of the long body portion comprises an integral cut and raised portion on each side of the end thereof, at least one of which is adapted to slidably engage a flange of a horizontal support member when the clip is positioned on said vertical panel support member.

* * * * *